US007905332B2

(12) United States Patent
Jayachandran

(10) Patent No.: US 7,905,332 B2
(45) Date of Patent: Mar. 15, 2011

(54) NOISE CONTROL STRATEGY FOR AN ELEVATOR SYSTEM

(75) Inventor: Vijay Jayachandran, West Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 558 days.

(21) Appl. No.: 12/063,583

(22) PCT Filed: Aug. 24, 2005

(86) PCT No.: PCT/US2005/030149

§ 371 (c)(1),
(2), (4) Date: Feb. 12, 2008

(87) PCT Pub. No.: WO2007/024223

PCT Pub. Date: Mar. 1, 2007

(65) Prior Publication Data

US 2010/0175952 A1 Jul. 15, 2010

(51) Int. Cl.
*B66B 7/00* (2006.01)

(52) U.S. Cl. ..... 187/414; 187/406

(58) Field of Classification Search ..... 187/406, 187/414

See application file for complete search history.

(56) References Cited

U.S. PATENT DOCUMENTS

| | | | | |
|---|---|---|---|---|
| 4,438,526 | A | 3/1984 | Thomalla | |
| 4,686,693 | A | 8/1987 | Ritter | |
| 5,010,576 | A | 4/1991 | Hill | |
| 5,025,893 | A | 6/1991 | Saito | |
| 5,135,079 | A | 8/1992 | Shimazaki | |
| 5,460,570 | A * | 10/1995 | Okamura et al. | 454/68 |
| 5,811,743 | A | 9/1998 | Kohara et al. | |
| 6,364,064 | B1 | 4/2002 | Rizzi | |
| 6,443,913 | B1 | 9/2002 | Kania | |
| 6,494,295 | B2 | 12/2002 | Grundmann | |
| 6,651,780 | B1 * | 11/2003 | Hakala et al. | 187/254 |

FOREIGN PATENT DOCUMENTS

| | | | |
|---|---|---|---|
| JP | 5-70053 A | * | 3/1993 |
| JP | 6-80357 A | * | 3/1994 |
| JP | 6-239571 A | * | 8/1994 |

OTHER PUBLICATIONS

International Search Report and Written Opinion of the International Searching Authority for International application No. PCT/US05/30149 mailed Mar. 14, 2006.

International Preliminary Report on Patentability for International application No. PCT/US05/30149 mailed Apr. 25, 2007.

* cited by examiner

*Primary Examiner* — Thomas J. Brahan

(74) *Attorney, Agent, or Firm* — Carlson, Gaskey & Olds PC

(57) ABSTRACT

A method of controlling noise noticeable within an elevator car (22) includes intentionally introducing noise into the elevator car (22) at a noise level that depends on the position of the car within a hoistway (24). A disclosed example includes using existing elevator system components for generating compensating noise at different levels corresponding to different positions of the car within the hoistway. One disclosed example includes increasing introduced noise as the car descends further away from a machine responsible for moving the car. The introduced noise reduces or eliminates changes in noticeable noise within the elevator car as the car moves relative to the machine. The disclosed examples have particular usefulness in machine roomless elevator systems although they are not necessarily limited to such systems.

7 Claims, 1 Drawing Sheet

NOISE CONTROL STRATEGY FOR AN ELEVATOR SYSTEM

FIELD OF THE INVENTION

This invention generally relates to elevator systems. More particularly, this invention relates to sound quality and noise control for elevator systems.

DESCRIPTION OF THE RELATED ART

Elevator systems come in a variety of forms. Many utilize a machine to move roping such as steel ropes or flat belts to cause desired movement of an elevator car between various levels of a building, for example. Traditionally, the elevator machine was located in a machine room above the hoistway within which the elevator car travels. More recently, machine roomless elevator systems have been introduced. While such systems have advantages in that they utilize less building space, for example, they are not without drawbacks.

For example, the location of the machine within the hoistway introduces another source of noise that is noticeable within some elevator car configurations. One aspect of this noise is that it tends to increase in loudness and becomes more noticeable as the elevator car approaches the machine, typically near the upper floors of the building. The noticeable change in noise within the elevator car as the car moves relative to the machine is considered undesirable. Passengers may be accustomed to a relatively constant level or slowly changing gradient in noise while riding in an elevator but typically are disturbed by rapidly changing levels of noise as the car is moving.

There is a need for an arrangement that reduces or eliminates the change in noticeable noise within an elevator car as it travels within a hoistway, for example. This invention addresses that need.

SUMMARY OF THE INVENTION

An exemplary disclosed method of controlling a noise level within an elevator car includes introducing noise into the elevator car in an amount that is dependent upon the location of the elevator car.

One disclosed example includes introducing noise into the elevator car such that it results in a generally consistent noise level in the elevator car along an entire distance traveled by the elevator car.

One example includes increasing the amount of introduced noise as the elevator car moves farther from the machine used to move the elevator car. In one example, increasing the amount of introduced noise occurs as the elevator car descends.

One example includes using at least one component associated with moving the elevator car other than the machine for introducing the noise. One example includes altering a surface on a guide rail such that interaction between at least one other component associated with the elevator car and the guide rail surface results in the introduced noise. One example includes different surface characteristics along different portions of the guide rail surface to introduce different levels of noise.

One example includes using roping or belts with varying characteristics for introducing the noise. In this case the varying level of noise is introduced by the varying levels of structural-acoustic interaction between the roping and the pulleys on the car frame.

An exemplary disclosed elevator system includes an elevator car and a machine for moving the elevator car. At least one other component introduces noise into the elevator car in an amount that depends on a distance between the elevator car and the machine.

The various features and advantages of this invention will become apparent to those skilled in the art from the following detailed description. The drawings that accompany the detailed description can be briefly described as follows.

DETAILED DESCRIPTION OF THE PREFERRED EMBODIMENTS

Figure 1:
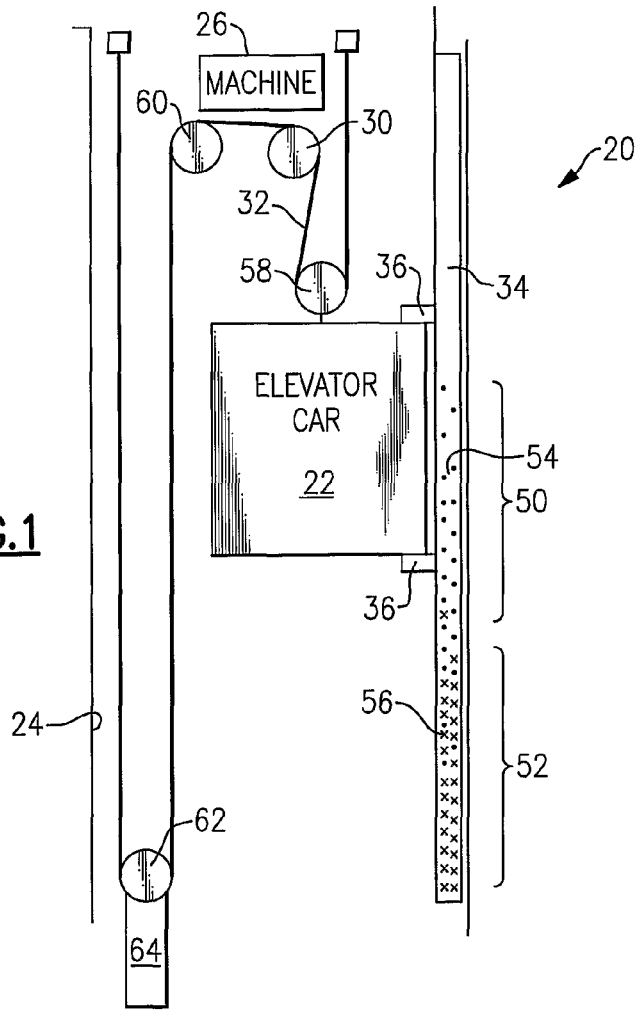
FIG. 1 schematically illustrates selected portions of an elevator system designed according to an embodiment of this invention.

FIG. 1 schematically shows selected portions of an elevator system 20. An elevator car 22 travels within a hoistway 24 responsive to operation of a machine 26.

In the illustrated example, the machine 26 causes a drive or traction sheave 30 to rotate to move a load bearing member 32 such as a steel rope or flat belt to cause desired movement of the car 22 within the hoistway 24. The illustration schematically shows a guide rail 34 that the elevator car 22 follows as it moves vertically within the hoistway 24. Guidance components 36 operate in a known manner to facilitate movement of the car 22 along the guide rail 34.

In this example, the elevator system 20 is a machine roomless system such that the machine 26 is supported within the hoistway 24 in a known manner. The presence of the machine 26 within the hoistway 24 introduces noise that can be noticed within the elevator car 22 especially when the elevator car 22 is close to the machine 26. For example, as the elevator car is closer to the machine 26, the machine noise is more noticeable. Such noise levels within the elevator car 22 are lower as the elevator car 22 descends or moves away from the machine. Because the machine 26 introduces noise in the hoistway 24 that can be noticed in the elevator car 22, the disclosed example includes a strategy for minimizing time rate of change in the amount of noticeable noise within the elevator car 22 regardless of the position of the elevator car 22 in the hoistway 24. The disclosed example includes intentionally introducing additional noise into the elevator car 22 depending on the position of the elevator car 22 to eliminate or at least reduce the changes in noticeable noise within the elevator car 22 as the car 22 moves relative to the machine 26.

Figure 2:
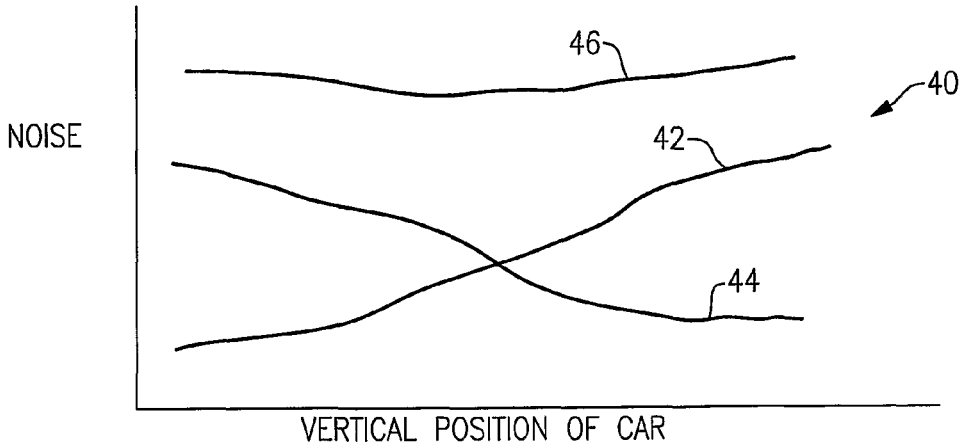
FIG. 2 is a graphical illustration summarizing one example approach designed according to an embodiment of this invention.

FIG. 2 graphically illustrates a noise profile 40 that shows changing noise levels with the changing vertical position of the car 22 within the hoistway 24. A first plot 42 represents the noise level noticeable within the elevator car 22 as caused by operation of the machine 26. In this example, the higher the elevator car rises, the greater the noise level introduced by the operation of the machine 26 becomes. If no other noise were intentionally introduced into the elevator car 22, the plot 42 would represent the total noticeable noise level within the elevator car 22 in some examples.

The disclosed example includes intentionally introducing additional noise into the elevator car 22 in an amount that depends on the position of the elevator car 22. FIG. 2 shows a plot 44 of intentionally introduced compensating noise. The introduced noise shown at 44 is greatest when the car is near a lowest position in this example. The introduced noise shown at 44 and the machine noise shown at 42 result in a total noticeable noise within the elevator car 22 shown by the plot 46. In this example, the total noise 46 that is noticeable within the elevator car 22 is generally consistent along the entire travel of the car 22 within the hoistway 24. The combined effects of the machine noise shown at 42 and the intentionally introduced noise shown at 44 results in a generally consistent total noise level 46 within the elevator car 22.

The disclosed example departs from traditional thinking, which has been to reduce the amount of noise noticeable within an elevator car 22. By intentionally introducing noise, the disclosed example goes directly contrary to many approaches in elevator system design. Rather than attempting to eliminate the noise introduced by operation of the machine 26, the disclosed example introduces additional, compensating noise to minimize the effects of any noticeable change in noise level within the elevator car 22 as the car 22 moves relative to the machine 26. The introduction of a defined amount of additional noise that provides for a consistent total noise level within the elevator car actually reduces the passenger's perception of noise and increases the sound quality inside the elevator car.

One example includes introducing a broadband noise to compensate for the changes in noticeable noise caused by changes in distance from the machine. A broadband noise in one such example is characterized by spectrally white content in the frequency range of interest.

One example embodiment utilizes existing elevator system components as a source for the introduced noise. In FIG. 1, the guide rail 34 has one portion 50 above another portion 52. A surface characteristic on each of the portions 50 and 52 is designed to cause interaction with the guidance components 36, for example, to introduce additional noise that can be noticed within the elevator car 22 as the car moves within the hoistway 24. In this example, the portion 50 of the guide rail 34 has a first surface characteristic 54, which may be a desired roughness, for example, that results in noise generation as the car moves along the guide rail. The guide rail portion 52 has another surface characteristic 56, which in this example includes an increased roughness for providing an increased level of sound as the elevator car 22 moves further away from the machine 26.

The example of FIG. 1 also includes deflector sheaves 58, 60 and 62. The sheave 58 travels with the elevator car 22 within the hoistway 24. The sheave 62 is associated with a counterweight 64. The deflector sheaves rotate as the load bearing member 32 passes over them. In this example, at least a portion of the surface of the load bearing member 32 is altered so that interaction between the load bearing member 32 and at least the deflector sheave 58 results in additional noise generation as the car 22 moves further away from the machine 26. Another example includes variations in sheave components to provide different noise levels at different heights in the hoistway 24. Given the particular roping arrangement and the components selected for an elevator system, those skilled in the art who have the benefit of this description will be able to select how to design those components to provide additional noise when the elevator car is at selected positions within the hoistway.

One example includes using a first component to introduce compensating noise when the elevator car 22 is within a first range of the machine 26. A second component adds more noise when the car 22 is within a second, further range of the machine 26. This example includes using more noise sources for louder noticeable levels of compensating noise as needed to achieve an overall total noise profile.

Another example includes a source of noise not directly associated with operating elevator system components. Such an additional source of noise may be incorporated into the elevator car 22 or appropriate locations within the hoistway 24 for introducing the additional level of noise desired for a particular elevator car position within the hoistway 24. One such example includes a speaker used to generate white noise that can be heard in the elevator car 22.

In another example, in case of very long hoistways, the noise profile may be flattened near the top of the hoistway and then gradually allowed to reduce in amplitude as the car gets further and further away from the machine. The rate of change of noise is controlled by the amount of injected noise at any point in the hoistway. Those skilled in the art who have the benefit of this description will be able to customize noise generation to achieve a desired noise profile.

The disclosed examples provide ways of reducing or avoiding undesirable changes in the level of noise noticeable within an elevator car as the car moves relative to a machine supported within the hoistway. One advantage to the disclosed examples is that they do not require redesigning the machine itself or the structure used to support the machine within the hoistway. Another advantage to the disclosed examples is that they utilize existing elevator system components in a new way to achieve a desired noise profile within an elevator car throughout travel along a hoistway.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A method of controlling a noise level within an elevator car, comprising:

introducing noise into the elevator car in an amount that is dependent on a location of the elevator car;

using at least one component associated with moving the elevator car for introducing the noise; and altering a surface on a guide rail such that interaction between at least one other component associated with the elevator car and the guide rail surface results in the introduced noise.

2. The method of claim 1, comprising providing different surface characteristics along different portions of the guide rail surface, respectively, to thereby introduce different amounts of noise as the at least one other component interacts with each of the different portions.

3. A method of controlling a noise level within an elevator car, comprising:

introducing noise into the elevator car in an amount that is dependent on a location of the elevator car;

using at least one component associated with moving the elevator car for introducing the noise; and altering a surface on one of a load bearing member used to support the elevator car or a sheave used to direct the load bearing member such that interaction between the load bearing member and the sheave results in the introduced noise.

4. An elevator system, comprising:

an elevator car;

a machine for moving the elevator car; and a guide rail having a characteristic that varies in a manner corresponding to a distance between the elevator car and the machine such that noise is introduced into the elevator car in an amount that depends on the distance between the elevator car and the machine.

5. The system of claim 4, wherein the guide rail comprises a first surface characteristic along a first portion of the guide rail and a second, different surface characteristic along a second portion of the guide rail and wherein the surface characteristics introduce corresponding amounts of noise.

6. An elevator system, comprising:

an elevator ear;

a machine for moving the elevator car; and a load bearing member for supporting the elevator car having a characteristic that varies in a manner corresponding to a distance between the elevator car and the machine such that noise is introduced into the elevator car in an amount that depends on the distance between the elevator car and the machine.

7. The system of claim 6, comprising at least one sheave for guiding the load bearing member and wherein the load bearing member has a noise generating surface along at least a portion of a length of the load bearing member for introducing the noise as the portion of the load bearing member interacts with the sheave.

* * * * *